United States Patent [19]

Bigo et al.

[11] Patent Number: 4,724,742

[45] Date of Patent: Feb. 16, 1988

[54] MOTOR OR PUMP MECHANISM HAVING AT LEAST TWO DISTINCT ACTIVE CYLINDER CAPACITIES

[75] Inventors: Louis Bigo, Compiegne; Bernard Allart, Crepy-en-Valois, both of France

[73] Assignee: Poclain Hydraulics, Verberie, France

[21] Appl. No.: 919,467

[22] Filed: Oct. 16, 1986

[30] Foreign Application Priority Data

Oct. 16, 1985 [FR] France ..... 85 15352

[51] Int. Cl.[4] ..... F01B 13/06

[52] U.S. Cl. ..... 91/491; 91/497

[58] Field of Search ..... 91/472, 491, 497

[56] References Cited

U.S. PATENT DOCUMENTS

| | | | |
|---|---|---|---|
| 3,369,457 | 2/1968 | Guinof | 91/491 |
| 3,593,621 | 7/1971 | Praddaude | 91/492 |
| 3,760,691 | 9/1973 | Alecrner | 91/472 |
| 4,157,056 | 6/1979 | Allart et al. | 91/491 |
| 4,404,896 | 9/1983 | Allart et al. | 91/497 |
| 4,532,854 | 8/1985 | Foster | 91/472 |

*Primary Examiner*—William L. Freeh

*Attorney, Agent, or Firm*—Brumbaugh, Graves, Donohue & Raymond

[57] ABSTRACT

The invention relates to a hydraulic motor having an undulating cam and at least one large and one small selectable operating cylinder capacity. In the motor, cylinder feed orifices (41*a*, 42*a*) are distributed around the circumference of a circle about the axis of rotation (5), and the small cylinder capacity corresponds to an irregular angular distribution of active cylinder orifices (41*a*) which continue to be fed. This configuration makes it possible to provide a constant velocity motor with at least two different cylinder capacities and which is mechanically long-lasting.

4 Claims, 15 Drawing Figures

PRIOR ART

Fig. 8
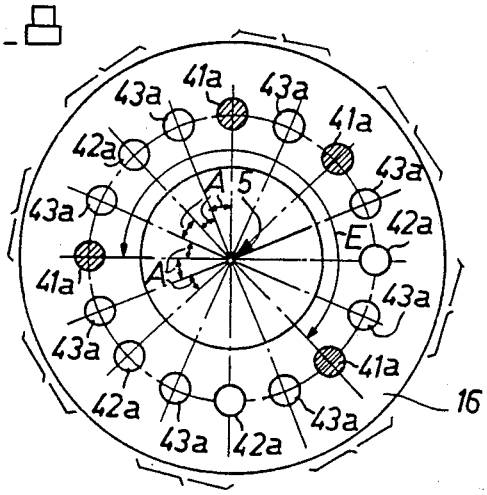
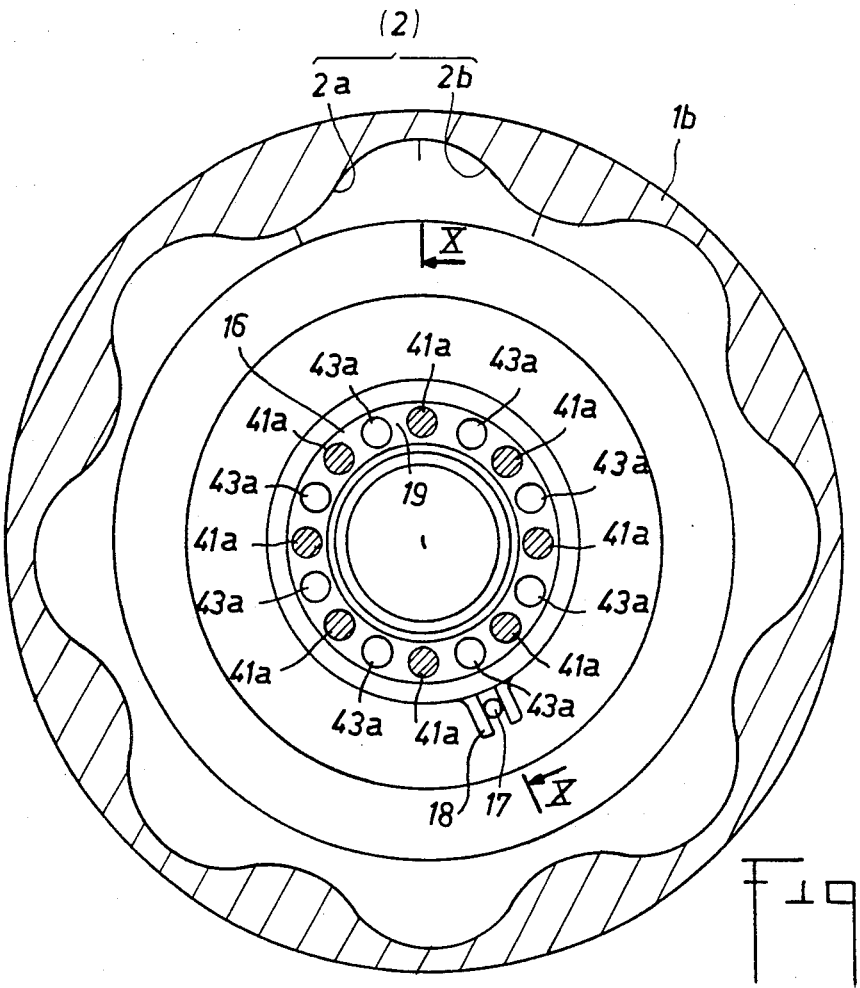
Fig. 14

MOTOR OR PUMP MECHANISM HAVING AT LEAST TWO DISTINCT ACTIVE CYLINDER CAPACITIES

BACKGROUND OF THE INVENTION

There exist hydraulic motors, and more generally mechanisms operating with fluid under pressure, which include a cylinder capacity selector enabling them to operate with at least two different cylinder capacities, and thus to rotate at two different speeds of rotation.

In these mechanisms, pistons are disposed either radially relative to the axis of rotation or parallel to the axis of rotation, giving rise to "radial-piston" and "axial-piston" mechanisms respectively.

In these mechanisms, the various pistons are mounted to bear against undulating cams, and in axial-piston mechanisms the cams are constituted by undulating reaction plates. Further, a fluid distributor valve which rotates with the cam serves to distribute fluid to cylinders in which the pistons are slidably mounted. The various possible embodiments of such a distributor valve include a generally cylindrical shape and a shape including a plane face (known as a "plane" distributor valve). Finally, the main effect of a cylinder capacity selector is to group together the cylinders of a mechanism in a plurality of distinct cylinder groups, or to group together the feeds corresponding to respective cam undulations in a plurality of distinct cam undulation groups.

The present invention relates to such mechanisms, and particular descriptions of some such mechanisms are to be found in the following French patent specifications: FR-A No. 1 411 047 (a motor having a plurality of cylinder capacities, a cylindrical distributor valve, and a selector for grouping the cylinders in a plurality of cylinder groups); FR-A No. 1 563 866 (a motor similar to the above motor, but having a selector which groups the feeds in a plurality of cam undulation groups); and FR-A No. 2 365 041 (a motor having a plurality of cylinder capacities and including a plane distributor valve).

More particularly, the invention relates to a first type of hydraulic motor or pump mechanism constituted by:

a cylinder block;

a plurality of cylinders provided in said cylinder block, with a piston slidably mounted in each cylinder and with each cylinder being provided with an orifice for communication with the outside thereof;

a cam, said cylinder block being rotatably mounted relative to said cam about an axis of rotation, said pistons being suitable for bearing against the surface of said cam, and said cam comprising a plurality of slopes which follow one another in pairs, with each pair including a first slope going away from the cylinder block relative to the general direction of piston sliding while pressed against said cam, and with the second slope of each pair sloping towards the cylinder block relative to the general direction of piston sliding;

two enclosures, one suitable for containing high pressure fluid and the other for containing low pressure fluid;

a fluid distributor valve constrained to rotate with the cam, and including as many pairs of orifices as the cam includes pairs of slopes, with the two orifices of a pair of orifices comprising a first orifice which corresponds to the first slope of a pair of slopes and a second orifice which corresponds to the second slope of the same pair of slopes, and with the orifice for putting each cylinder into communication with the outside of the cylinder being successively brought into communication with each pair of orifices in the distributor during rotation of the cylinder block relative to the cam; and a selector for selecting the active cylinder capacity of the mechanism and capable of conferring at least two distinct configurations on said mechanism, including a first configuration in which communication is established firstly between all of said first orifices of said pairs of distributor valve orifices and a first one of said two enclosures, and secondly between all said second orifices of said pairs of distributor valve orifices and the second of said two enclosures, and a second configuration in which the pairs of distributor valve orifices are grouped in at least two groups of pairs of orifices corresponding to at least two groups of pairs of cam slopes, said selector firstly establishing said first configuration communication solely for the orifices of a first of said two groups of pairs of distributor valve orifices, and secondly isolating at least one of said two enclosures from at least one of said first and second orifices of the pairs of orifices of the second of said two groups of pairs of orifices.

The invention also relates to a second type of hydraulic motor or pump mechanism constituted by:

a cylinder block;

a plurality of cylinders provided in said cylinder block, with a piston slidably mounted in each cylinder and with each cylinder being provided with an orifice for communication with the outside thereof;

a cam, said cylinder block being rotatably mounted relative to said cam about an axis of rotation, said pistons being suitable for bearing against the surface of said cam, and said cam comprising a plurality of slopes which follow one another in pairs, with each pair including a first slope going away from the cylinder block relative to the general direction of the piston sliding while pressed against said cam, and with the second slope of each pair sloping towards the cylinder block relative to the general direction of the piston sliding;

two enclosures, one suitable for containing high pressure fluid and the other for containing low pressure fluid;

a fluid distributor valve constrained to rotate with the cam, and including as many pairs of orifices as the cam includes pairs of slopes, with the two orifices of a pair of orifices comprising a first orifice which corresponds to the first slope of a pair of slopes and a second orifice which corresponds to the second slope of the same pair of slopes, and with the orifice for putting each cylinder into communication with the outside of the cylinder being successively brought into communication with each pair of orifices in the distributor during rotation of the cylinder block relative to the cam; and a selector for selecting the active cylinder capacity of the mechanism and suitable for conferring at least two different configurations to said mechanism, including a first configuration in which the selector establishes communication during said relative rotation between the orifice for putting each cylinder into communication with the outside from said cylinder successively with each of the two orifices in each pair of distributor valve orifices, and a second configuration in which the cylinders are distributed together with their said communication orifices in at least two groups of cylinders and two corresponding groups of communication orifices, with the selector establishing first configuration communication solely for the communication orifices of a first group of said two groups of cylinder communication orifices while simultaneously isolating at least one of said two enclosures from the communication orifices of the second group of cylinder communication orifices, said cylinders being distributed around the axis of relative rotation between the cylinder block and the cam with the axes of any pair of consecutive cylinders being at substantially at the same angular intervals.

In the above known types of hydraulic mechanism, two complementary dispositions are adopted. The first complementary disposition consists in selecting cam profiles so that each of the operating cylinder capacities remains constant: such a mechanism is known as a "constant-velocity" mechanism and this disposition has the advantage of obtaining a constant speed of rotation for the mechanism at a given cylinder capacity and a given fluid flow rate. The second complementary disposition consists in providing the smaller operating cylinder capacity by preventing some of the cylinders from communicating with the high and low pressure enclosures of the mechanism, and by choosing these cylinders so that they are regularly distributed angularly around the axis of rotation. For example, during one turn about the axis of rotation every other cylinder may be isolated in succession from at least one of the said two enclosures. This method of proceeding has an obvious advantage which is unfortunately accompanied by a very awkward drawback. The advantage obtained is to maintain a zero or substantially zero resultant of the forces due to the effects of the fluid under pressure contained in those cylinders which are still active. The serious drawback observed lies in the fact that in order to maintain constant each of the possible operating cylinder capacities, calculation shows that the cam profiles must have small radiuses of curvature, and in particular radiuses which are so small that the corresponding high contact pressures exerted on the cam significantly reduce the lifetime of the mechanism. Thus, known multiple cylinder capacity mechanisms are indeed contant-velocity mechanisms and they do indeed have force resultants perpendicular to the axis of rotation which are small or zero, but their lifetimes are shortened by premature destruction of the cams and/or the members which bear against them.

The invention consists in overcoming the technical prejudice relating to obtaining a small or zero resultant for forces perpendicular to the axis of rotation, i.e. for "radial forces" as described above, in selecting a solution which, a priori is bad from this point of view, i.e. in selecting a solution which leads to a non-zero resultant of these forces being generated and which thus leads to the corresponding mechanism being inherently somewhat out-of-balance by its very design; and then in showing that it is possible to make constant velocity mechanisms having a plurality of (i.e. at least two) different operating cylinder capacities with cam profiles which have satisfactory radiuses of curvature. The above-mentioned severe drawback of prior mechanisms is thus avoided and this type of mechanism is rendered usable in an industrial context, albeit at the price of generating a parasitic resultant force on the axis of rotation. After daring to propose a solution which is a priori bad, and thus genuinely non-obvious to the person skilled in the art, the applicant's invention has further merit which is just as remarkable: not only is it possible to eliminate the drawback of the prior art (relating to the bad cam profile), but it is also possible to find a solution to the new drawback (that of generating a non-zero resultant axial force): rotary bearings currently available on the market are quite capable of absorbing the above-mentioned resultant force without difficulty.

SUMMARY OF THE INVENTION

Thus, for a mechanism of the first above-mentioned type, the invention consists in adopting dispositions whereby, in said second configuration the pairs of cam slopes corresponding to the pairs of orifices in the first group of pairs of distributor valve orifices are angularly distributed about the axis of relative rotation between the cylinder block and the cam in an irregular manner.

Preferably, the number of pairs of cam slopes is an even number, and the number of pairs of orifices of the first group of pairs of distributor valve orifices is equal to not more than one-half of the total number of pairs of orifices in said second configuration, said pairs of orifices of the first group being distributed over an arc of a circle representing said relative rotation and extending over more than 180°.

For a mechanism of the second above-mentioned type, the invention consists in adopting a disposition whereby, in said second configuration, the cylinders of said first group are angularly distributed about said axis of relative rotation in an irregular manner, i.e. with the angular intervals between the axes of two consecutive cylinders in the first group of cylinders being unequal for at least some of the angular intervals between pairs of successive cylinders in the first group of cylinders.

Preferably, there is an even number of cylinders and in the second configuration the number of cylinders in the first group is not greater than one-half the total number of cylinders, with the cylinders of the first group in said second configuration being distributed around an arc of a circle representing said relative rotation and extending over more than 180°.

The advantage of the invention lies in the new possibility of providing constant-velocity mechanisms having a plurality of cylinder capacities and having satisfactory mechanical strength. A single figure demonstrates the progress achieved; in comparison with prior mechanisms, novel mechanisms in accordance with the invention have a lifetime which is multiplied by a factor lying in the range 4 to 10.

BRIEF DESCRIPTION OF THE DRAWINGS

Embodiments of the invention are described by way of example with reference to the accompanying drawings, in which:

FIGS. 7 and 8 are sections analogous to FIG. 5 through two motors analogous to the FIG. 4 motor, but in accordance with the invention;

FIG. 14 is a section on line XIV—XIV of FIG. 10; and

MORE DETAILED DESCRIPTION

Figure 1:
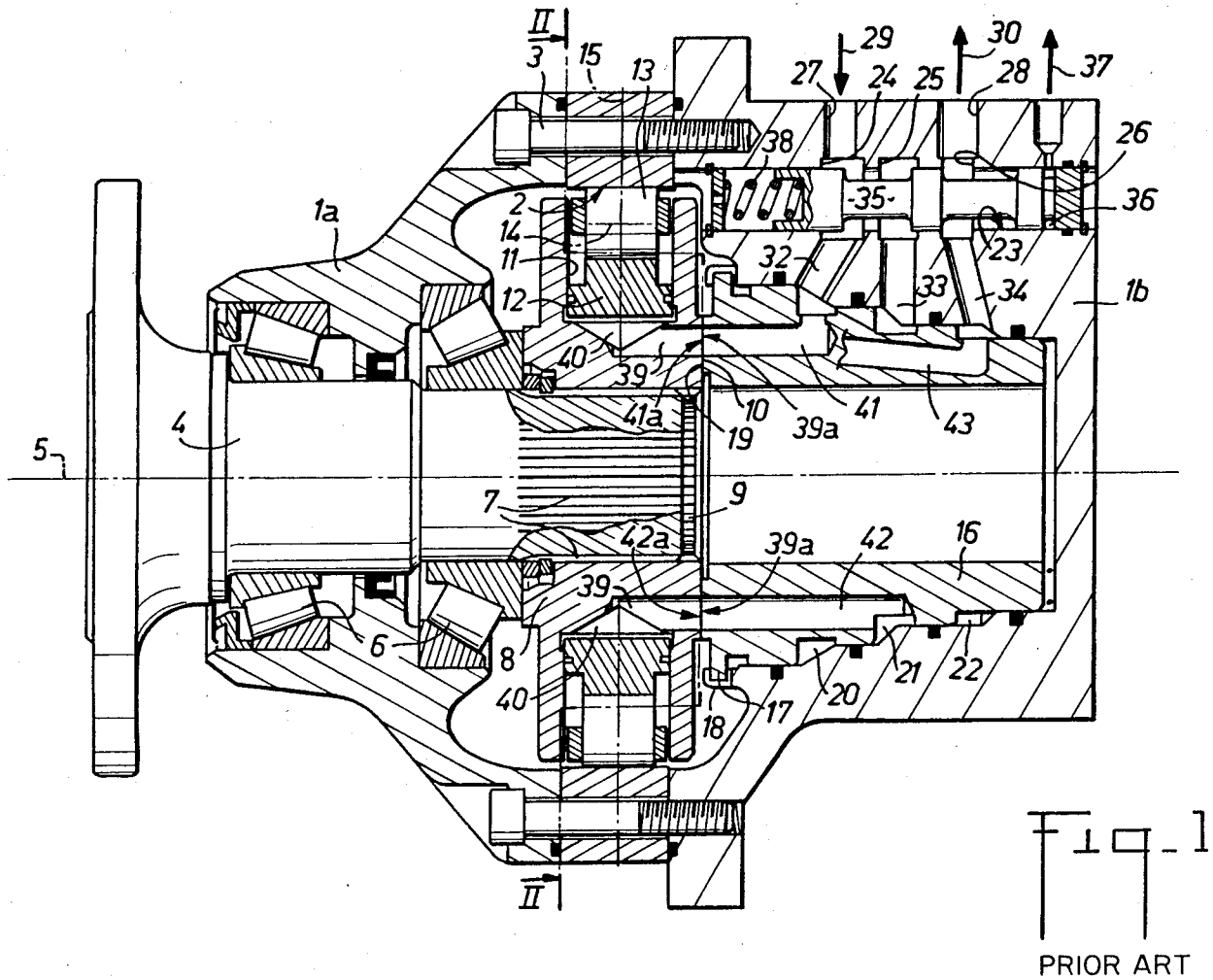
FIG. 1 is an axial section on a line I—I of FIG. 2 through a prior art hydraulic motor, shown in a first operating configuration.

The hydraulic motor shown in FIG. 1 comprises:

a two-part housing 1*a* and 1*b*;

an undulating cam 2 disposed between joint planes of the portions 1*a* and 1*b* of the housing, said cam 2 and said two portions 1*a* and 1*b* being fixed together by screws 3;

an outlet shaft 4 which is rotatably mounted relative to the housing 1*a* and 1*b* about an axis of rotation 5 by means of roller bearings 6, with the inside end of the shaft 4 being fluted at 7;

a cylinder-block 8 having a central bore with fluting 9, which is rotatably mounted relative to the housing 1*a* and 1*b* by co-operation between its fluting 9 and the fluting 7 on the shaft 4, which is thus constrained to rotate with said shaft 4, and which includes a plane face 10 perpendicular to the axis of rotation 5;

a plurality of cylinders 11 disposed radially through the cylinder block 8 at a regular angular spacing;

pistons 12 slidably mounted in respective ones of said cylinders 11;

cylindrical cam followers 13 rotatably mounted on the pistons 12 about axes 14 each of which is perpendicular to the axis 15 of the corresponding piston, said cam followers being in rolling contact with the surface of the cam 2;

a fluid distributor valve 16 which is constrained to rotate with the portion 1*b* of the housing by means of pegs 17 held in forks 18, and which possesses a plane face 19 perpendicular to the axis of rotation 5 and pressed against the plane face 10 of the cylinder block 8;

three circumferentially extending grooves 20, 21, and 22 provided between said distributor valve 16 and the portion 1*b* of the housing;

an eccentric bore 23 provided in said portion 1*b* of the housing and including three circumferentially extending grooves 24, 25, and 26;

two external connections 27 and 28 respectively connecting the grooves 24 and 26 around the bore 23 to a source 29 of fluid under pressure and to an exhaust tank 30 under substantially no pressure;

three ducts 32, 33, and 34 connecting the grooves 24, 25, and 26 around the eccentric bore 23 to the grooves 20, 21, and 22 respectively;

a cylinder capacity selector slide 35 which is slideably mounted in the eccentric bore 23, which has one end defining an operating chamber 36 capable of being selectively put into communication with or isolated from a source 37 of drive fluid, and which has its other end subjected to the action of a return spring 38 which opposes the action of the drive fluid in the operating chamber 36;

cylinder ducts 39 provided through the cylinder-block 8 with each cylinder duct 39 connecting the drive chamber 40 of a corresponding cylinder 11 to the plane face 10 of the cylinder block, and with the orifices 39*a* via which the cylinder ducts 39 open out into the face 10 being disposed around a circle on the face 10 at regular angular spacings around the axis of rotation 5; and ducts 41, 42, and 43 connecting each of the grooves 20, 21, 22 to the plane face 19 of the distributor valve 16 and opening out in said plane face 19 via respective orifices 41*a*, 42*a*, and 43*a* which are regularly angularly spaced around the axis of rotation 5 and which are suitable for being put into communication with the orifices 39*a* of the various cylinders, in succession.

When the operating chamber 36 is connected to a tank of fluid at no pressure, the spring 38 thrusts the slide 35 to the right (as shown in FIG. 1) and puts the grooves 24 and 25 into communication with each other while isolating them from the third groove 26. In contrast, when drive fluid is admitted into the operating chamber 36, the slide 35 is thrust to the left (as shown in FIG. 4) and puts the grooves 25 and 26 into communication with each other while isolating them from the groove 24.

Figure 2:
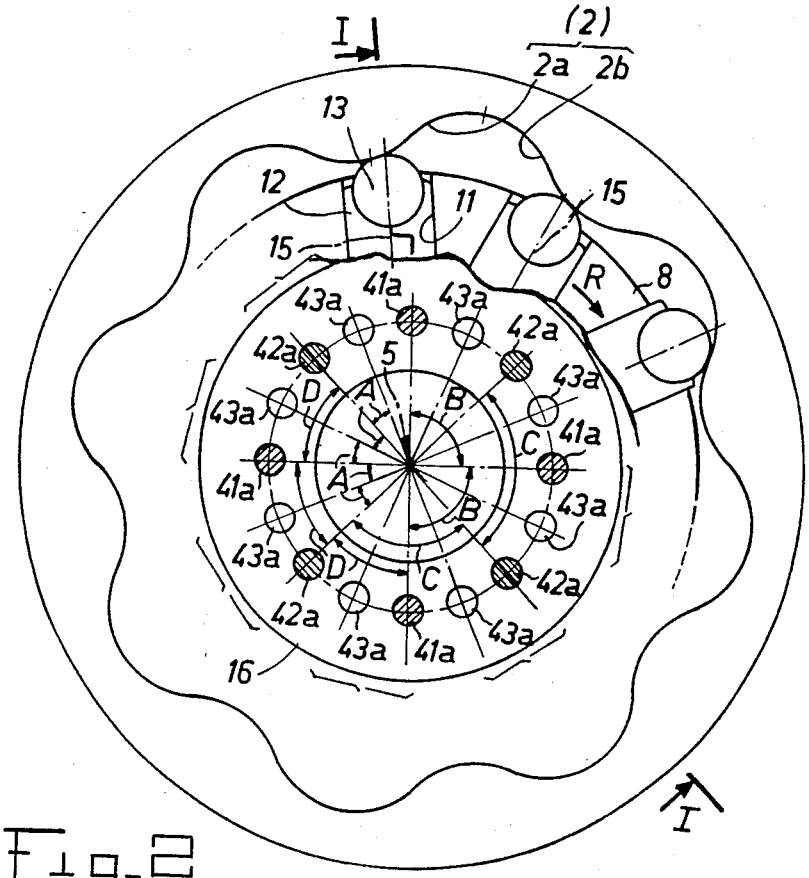
Fig. 2 PRIOR ART
FIG. 2 is a section on line II—II of FIG. 1.
Figure 3:
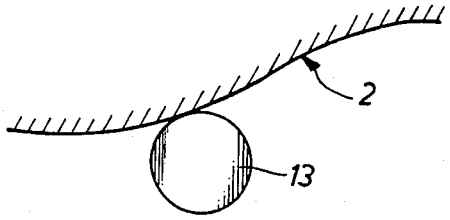
Fig. 3 PRIOR ART
FIG. 3 shows the slope profile of the FIG. 1 drive cam.

In FIG. 2, it can be seen that the orifices 41*a*, 42*a*, and 43*a* are regularly angularly distributed one after the other with a constant angle A between the radiuses joining the axis of rotation 5 to the axes of any two adjacent ones of the orifices, and also that the four orifices 41*a* are regularly angularly distributed at 90° intervals (angle B), and that the four orifices 42*a* are also regularly angularly distributed at intervals of 90° (angle C) with each orifice 42*a* always being at the same angular interval (45°=angle D) from two successive orifices 41*a*. This is the known prior disposition. The orifices 41*a* and 42*a* are shaded in different manners firstly to distinguish them from each other and secondly to show that they contain fluid from the source of fluid under pressure 29. In contrast, the orifices 43*a* are not shaded since they are in communication with the tank of fluid 30 at no pressure. In the FIG. 2 operating configuration of such a known motor (i.e. a configuration which corresponds to the larger cylinder capacity of the motor) it is possible to calculate a profile for the cam 2 (e.g. as shown in FIG. 3) which corresponds to an overall constant cylinder capacity for the motor (a "constant velocity" motor). In addition, in this profile, the radiuses of curvature are large enough to ensure satisfactory mechanism endurance. It may also be observed that since the cylinder block 8 turns in the direction of arrow R relative to the cam, the cam is constituted by a succession of pairs of slopes 2*a*–2*b*, with the slopes 2*a* corresponding to the piston 12 sliding out from its cylinder 11 and the slopes 2*b* corresponding to a piston sliding in the opposite direction, i.e. into its cylinder (when the cylinder block is indeed rotating in the direction of arrow R). Each slope 2*a* corresponds either to one the orifices 41*a* or else to one of the orifices 42*a*, and each slope 2*b* corresponds to one of the orifices 43*a* in the distributor valve 16. There is no further need to distinguish the slopes 2*a* and 2*b*, and reference is generally made below solely to the cam 2.

Figure 4:
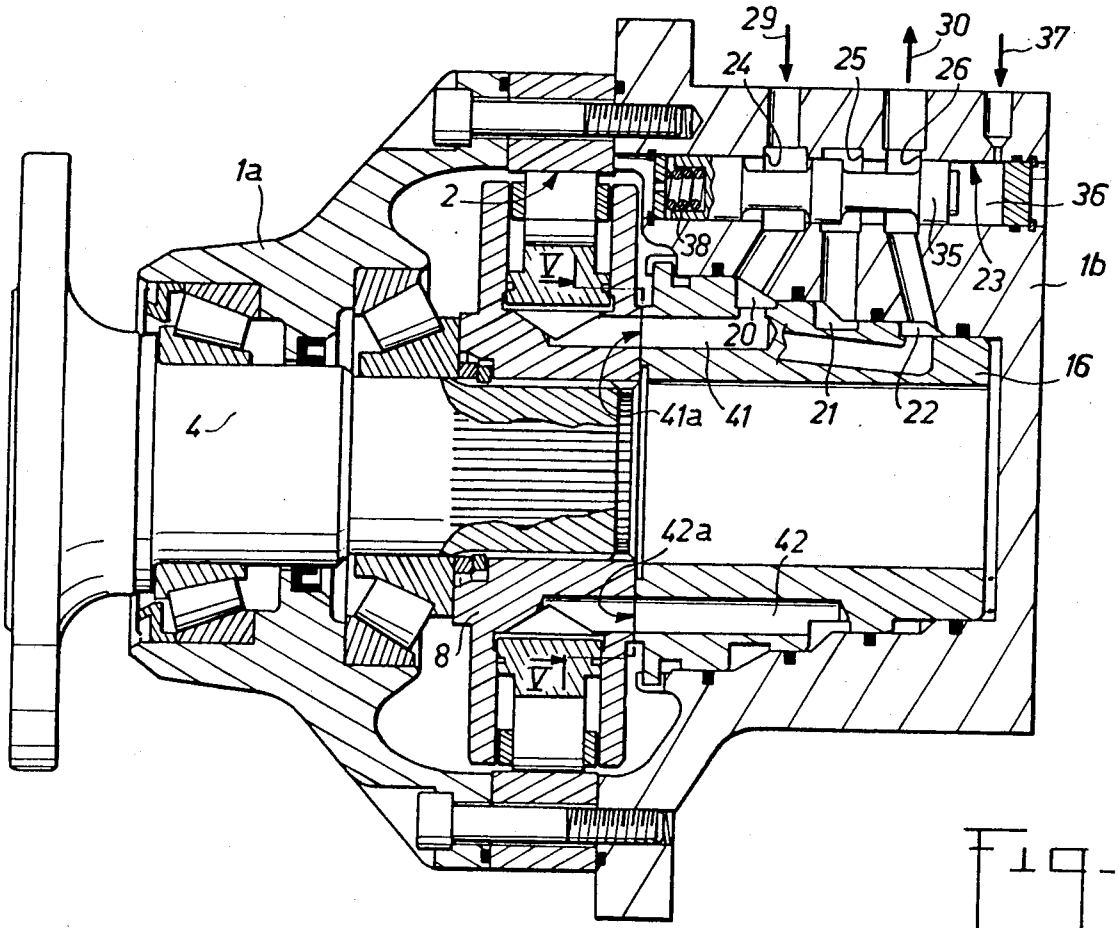
FIG. 4 PRIOR ART
FIG. 4 is an axial section through the FIG. 1 motor shown in its second operating configuration.

In the prior art, corresponding operation is obtained at the smaller cylinder capacity by putting the orifices 42*a* into communication with the tank 30 of fluid at no pressure by inserting drive fluid (37) into the operating chamber 36, thereby thrusting the slide 35 to the left (see FIG. 4).

Figure 5:
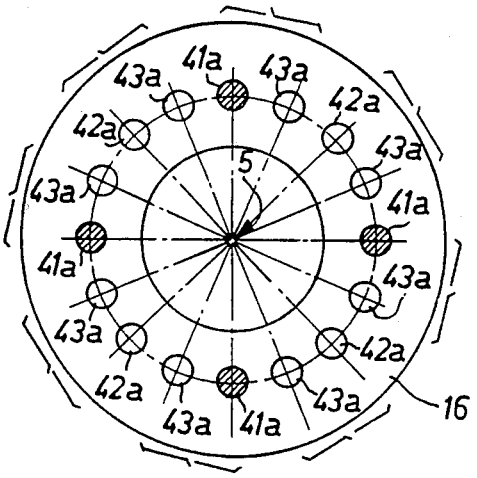
Fig. 5 PRIOR ART
FIG. 5 is a section on line V—V of FIG. 4.
Figure 6:
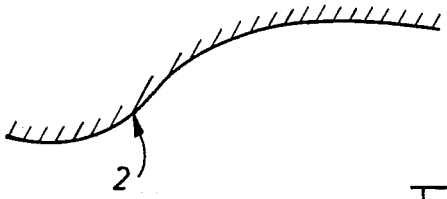
FIG. 6 shows the slope profile that must be given to the cam in order to ensure that the FIG. 4 motor is a constant velocity motor.

FIG. 5 is a diagram showing fluid feed to the cylinders in this configuration, with the orifices 42*a* being shown without shading since they contain fluid at the same pressure as the exhaust orifices 43*a*. It will be understood that the resultant of the forces due to the pressure in the active chambers of the cylinders communicating with the orifices 41*a* is zero or substantially zero on the axis of rotation 5. However, in order to obtain a "constant-velocity" motor, it has been found impossible to design a profile for the cam 2 which is better than the profile shown in FIG. 6. Unfortunately, this profile which is different from the FIG. 3 profile but which does provide overall constant operating cylinder capacity for the motor in both its small capacity and its large capacity configurations is bad from the mechanical point of view since some of its radiuses of curvature are too small.

Figure 7:
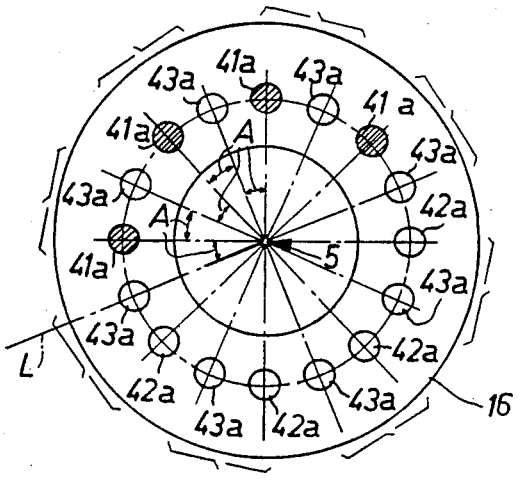

In a first embodiment of the invention, shown in FIG. 7, the orifices 41*a*, 42*a*, and 43*a* are still regularly angularly spaced from one another (angles A unchanged) with an orifice 43*a* being interposed between two consecutive ones of the other orifices 41*a* or 42*a*. However, the novelity lies in disposing all of the orifices 41*a* on the same side of a diameter L, and consequently disposing all of the orifices 42*a* on the other side of the diameter L. Thus, the angle between successive orifices 41*a* around the axis 5 is either 2A or 10A, thereby constituting a highly irregular distribution. FIG. 7 corresponds to the motor operating at its small cylinder capacity, in other words with feed being applied to the orifices 41*a* only, since when operating at its large cylinder capacity the feed diagram shown in FIG. 2 still applies, apart from the references applied to the various orifices which remain as shown in FIG. 7. Obviously the resultant of the pressure forces which obtains using the FIG. 7 disposition is non-zero. However, and here lies the great advantage of this novel solution, calculation and tests have shown that a profile may be designed for the cam 2, for example the profile shown in FIG. 9, which provides a motor which is "constant-velocity" in both of its possible operating configurations (large and small cylinder capacity), while also being satisfactory from the point of view of mechanical endurance since it is free from radiuses of curvature which are too small.

Figure 9:
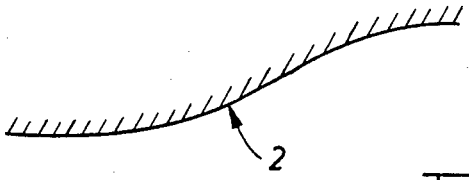
FIG. 9 shows the cam profile of the motors whose sections are shown in FIGS. 7 and 8.

The same line of research and development which has given rise to the feed disposition shown in FIG. 7 can still be followed while attempting to re-center the position of the resultant of the forces closer to the axis 5. FIG. 8 shows a disposition in accordance with the invention and with a resultant closer to the axis. In FIG. 8, one of the orifices 41*a* which is constantly fed with fluid under pressure is swapped over in position with the diametrically opposite orifice 42*a*. In this case, the orifices 41*a* follow one another over a circular arc E which extends over more than 180° (E=225°) and the spacing between successive orifices 41*a* is irregular (2A, 4A, and 6A), while still allowing the cam 2 to have a satisfactory profile, e.g. as shown in FIG. 9.

The motors shown in FIGS. 1 to 9 are motors having two different cylinder capacities with the cylinder capacity being selected by selecting which cams are to be active, i.e. which cams co-operate with cylinders that are being fed with fluid under pressure.

Other motors are known in which the cylinder capacity is selected by grouping the cylinders in at least two groups and by selectively feeding fluid under pressure to the cylinders of one of said groups. Motors in accordance with the invention as shown in FIGS. 10 to 14 belong to this latter type of multiple cylinder capacity motor in which the cylinder capacity is selected by selecting which cylinders are to be active (instead of which cams).

Figure 10:
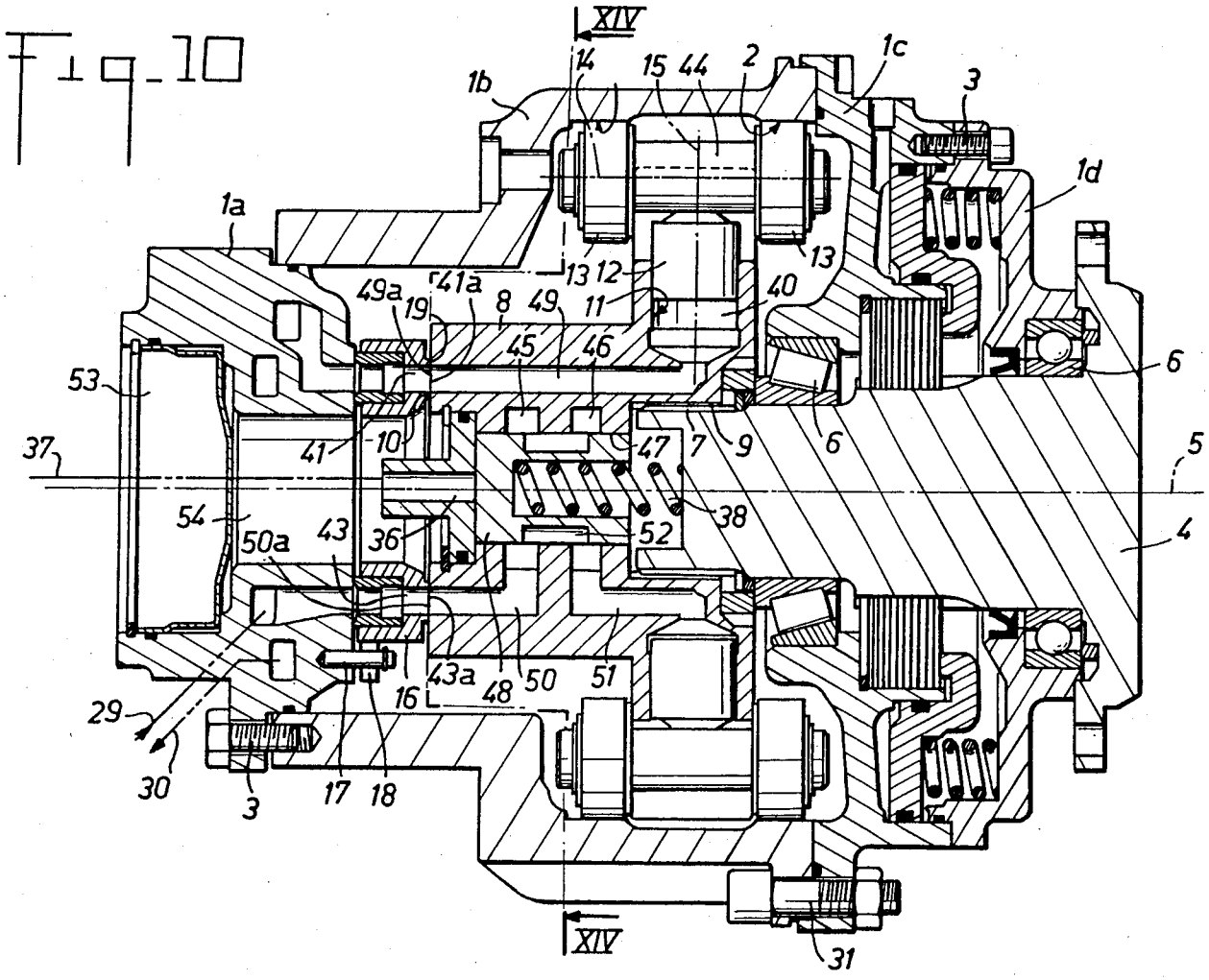
FIG. 10 is an axial section on a line X—X of FIG. 14 through a motor in accordance with the invention, which motor is shown in a first operating configuration and is of a type different from that shown in FIG. 1.
Figure 11:
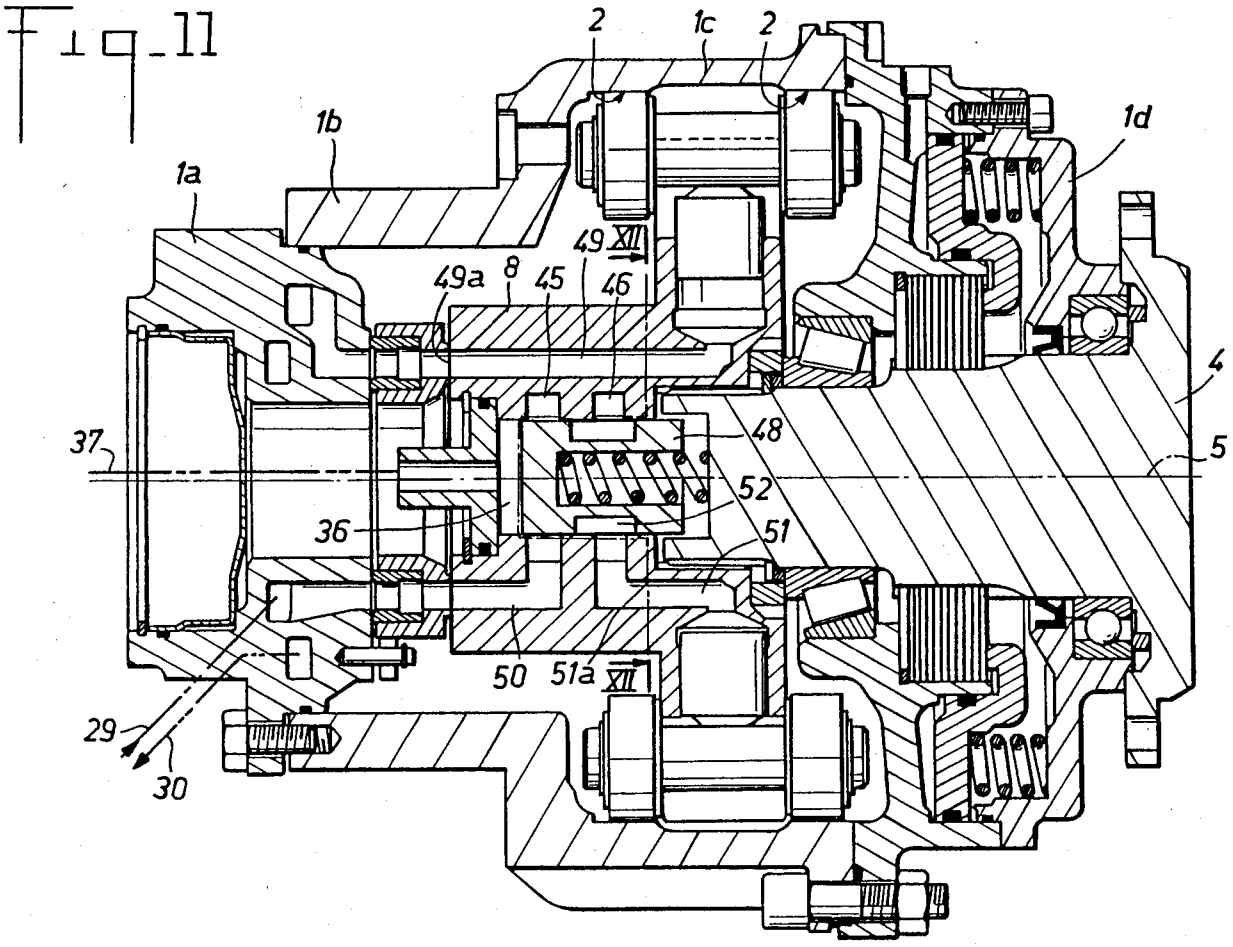
FIG. 11 is an axial section on line XI—XI of FIG. 12 through the FIG. 10 motor, but showing it in a second operating configuration.

The hydraulic motor shown in FIG. 10 comprises:

a four-portion housing 1*a*, 1*b*, 1*c*, and 1*d*, with the portions being assembled by screws 3 and bolts 31;

a two-ring undulating cam 2;

an output shaft 4 which is rotatably mounted relative to the housing about an axis of rotation 5 by means of roller and ball bearings 6, with the inside end of the shaft 4 being fluted at 7;

a cylinder block 8 having a central bore with fluting 9, which is rotatably mounted relative to the housing by virtue of its fluting 9 co-operating with the fluting 7 on the shaft 4, which is thus constrained to rotate with said shaft 4, and which includes a plane face 10 perpendicular to the axis of rotation 5;

cylinders 11 which are disposed radially in the cylinder block 8 and which are at a regular angular spacing;

pistons 12 each slidably mounted in a respective one of the cylinders 11;

cam follower wheels 13 rotatably mounted in pairs, with the cam followers of each pair being mounted at respective ends of corresponding beams 44 each of which is guided in a corresponding groove in the cylinder block 8, and each piston 12 bearing against a corresponding beam 44 and causing the corresponding cam followers 13 to be pressed against two cam tracks 2, with the cam followers having axes of rotation 14 which are perpendicular to the axes 15 of the corresponding pistons;

a fluid distributor valve 16 which is constrained to rotate with the housing portion 1*b* by means of a peg 17 received in a fork 18, which has a plane face 19 perpendicular to the axis of rotation 5 and pressed against the plane face 10 of the cylinder block 8, and in which two groups of ducts 41 and 43 are provided, which groups are respectively connected to a source of fluid under pressure 29 and to a tank of fluid at no pressure 30, and which open out into the face 19 via respective orifices 41*a* and 43*a*, (FIG. 14 is a section showing how the orifices 41*a* and 43*a* are regularly distributed and also showing how the cam is constituted by a succession of pairs of slopes 2*a*–2*b* such that each slope 2*a* corresponds to an orifice 41*a* and each slope 2*b* corresponds to an orifice 43*a*);

two circumferential grooves 45 and 46 provided in the wall of an axial bore 47 through the cylinder block 8;

a slide 48 of cylindrical section which is slidably mounted in the bore 47, which has one end contained in an operating chamber 36 capable of being selectively put into communication with or isolated from a source of drive fluid 39, and which has its other end subjected to the action of the return spring 38 opposing the action of the drive fluid in the operating chamber 36;

the cylinders 11 are thus distributed in two groups: a first group whose chambers 40 communicate with the face 10 of the cylinder block 8 via ducts 49 which are continuous and direct; and a second group communicating via ducts 51 leading to the groove 46, via ducts 50 connecting the groove 45 to the face 10 and via ducts 52 provided in the slide 48 and opening out into its cylindrical surface in such a manner as to be capable of interconnecting the grooves 45 and 46 (FIG. 10) or else of isolating them from one another (see FIG. 11);

a cover 53 is fitted to one end of the housing portion 1*a* and contributes to constituting a closed enclosure 54 suitable for containing drive fluid for the slide 48.

It should be observed that the orifices 49*a* and 50*a* via which the ducts 49 and 50 open out into the plane face 10 of cylinder block 8 are suitable for coming periodically into communication with the orifices 41*a* and 43*a* of the distributor valve 48.

Figure 12:
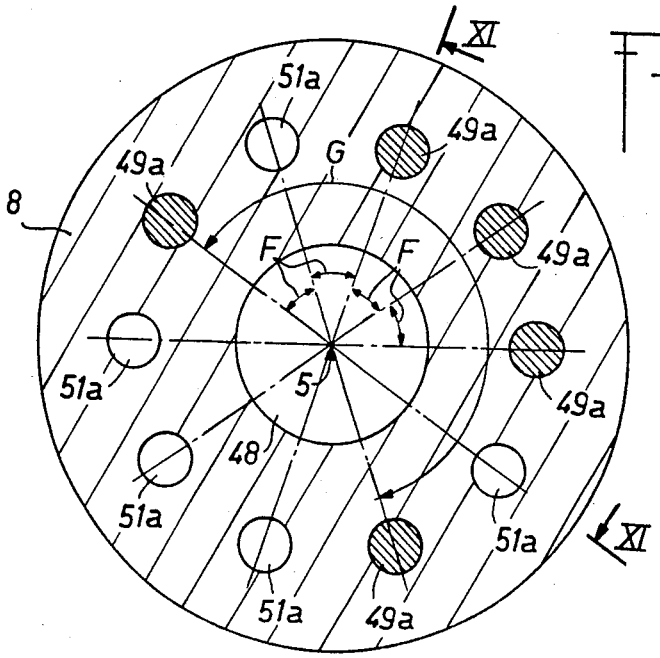
FIGS. 12 and 13 are two sections on line XII—XII of FIG. 11.
Figure 13:
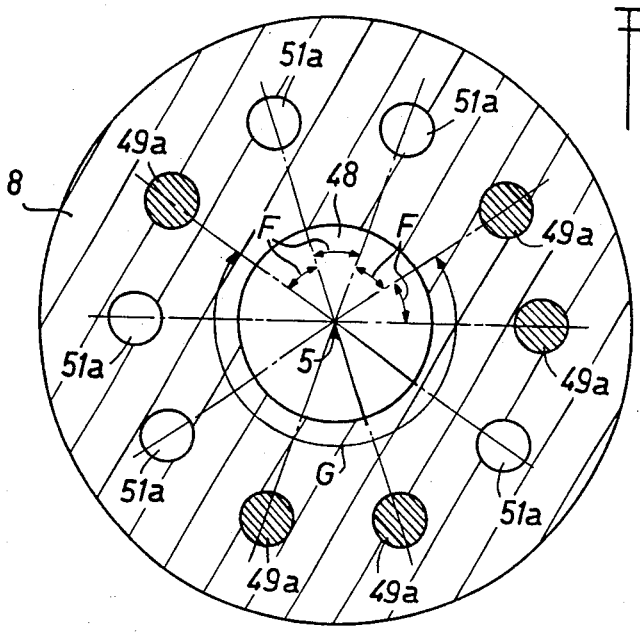

FIGS. 12 and 13 show the distribution of the orifices 49*a* and 51*a* of the bores 49 and 51 where they pass through the section XII—XII. In the FIG. 11 configuration only the orifices 49*a* (i.e. the shaded orifices) are capable of being put into communication with the source 29 of fluid under pressure, while the orifices 51*a* are never in communication therewith. This configuration shown in FIGS. 11, 12 and 13 of the drawings corresponds to the smaller cylinder capacity of the motor in which only one-half of the cylinders (the cylinders which correspond to the ducts 49) are periodically fed with fluid under pressure. A section corresponding to the larger cylinder capacity being selected has not been shown: such a section would differ from the sections of FIGS. 12 and 13 solely by the fact that all of the orifices 49*a* and 51*a* are capable of being successively put into communication with the source 29 of fluid under pressure.

With reference to FIGS. 12 and 13, the following points can be seen: taken as a whole, the orifices 49*a* and 51*a* are regularly angularly spaced from one another around the axis 5 at an angle F;

however, the orifices 49*a* are angularly disposed in an irregular manner (F, 2F, and 3F or 4F between two consecutive orifices 49*a*) and in particular, they are not each of them disposed between a pair of orifices 51*a*;

these orifices 49*a* extend over an arc of a circle G which is greater than 180° (G=216° in FIG. 12, G=252° in FIG. 13);

the ducts 50 and 51 extend along the same axis parallel to the axis of rotation 5.

In the motor shown in FIGS. 10 to 13, it can be seen that the irregularity in the distribution of the orifices 49*a* causes a non-zero resultant of the pressure forces to be generated, but also that it is possible to calculate a profile for the cam 2 such that the motor is a constant velocity motor both for its large cylinder capacity and its small cylinder capacity and giving rise to a cam profile which is satisfactory in avoiding excessively small radiuses of curvature, in a manner analogous to the profile shown in FIG. 9. This motor is thus mechanically long-lasting. The problem of counteracting the resultant of the axial forces is simply resolved by selecting suitable bearings 6.

Figure 15:
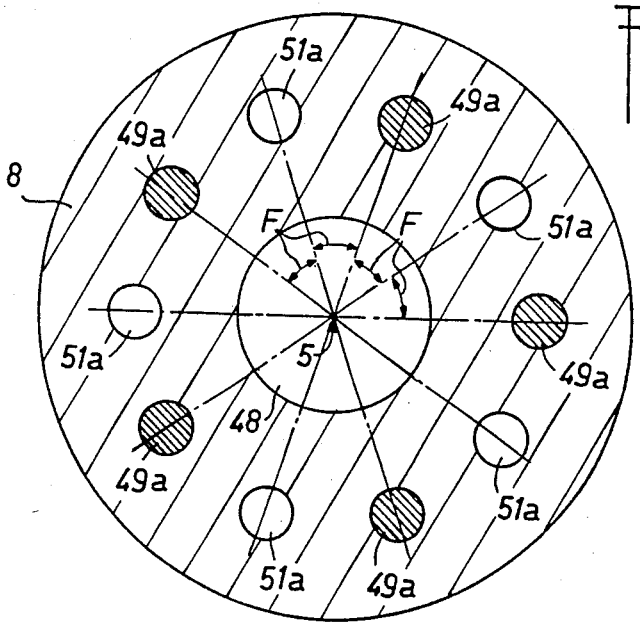
FIG. 15 is a section analogous to FIG. 12 through a prior art hydraulic motor in an operating configuration analogous to the second motor configuration shown in FIG. 11.

In a motor of similar construction to the motor shown in FIGS. 10 to 13, but known prior to the invention, the small cylinder capacity would have been obtained by distributing the orifices 49*a* and 51*a* in the manner shown in FIG. 15. It can be seen in FIG. 15 that the regular angular disposition of the orifices 49*a* gives rise to an angle 2F between any two successive orifices 49*a* or 51*a*. In addition, each orifice 49*a* is disposed between a pair of orifices 52*a* and is separated from each of them by an angle F. Such a prior art motor may be designed so that it is a constant velocity motor, however in this case it is observed that the necessary cam profile is bad from the mechanical point of view since some of its radiuses of curvature are too small, unlike the cam profiles suitable for motors in accordance with the invention (and shown in FIGS. 12 and 13).

The invention is not limited to the embodiments described, but is applicable to any variant thereof which falls within the scope of the claims.

We claim:

1. A hydraulic motor or pump mechanism, constituted by:

a cylinder block;

a plurality of cylinders provided in said cylinder block, with a piston slidably mounted in each cylinder and with each cylinder being provided with an orifice for communication with the outside thereof;

a cam, said cylinder block being rotatably mounted relative to said cam about an axis of rotation, said pistons being suitable for bearing against the surface of said cam, and said cam comprising a plurality of slopes which follow one another in pairs, with each pair including a first slope going away from the cylinder block relative to the general direction of piston sliding while pressed against said cam, and with the second slope of each pair sloping towards the cylinder block relative to the general direction of piston sliding;

two enclosures, one suitable for containing high pressure fluid and the other for containing low pressure fluid;

a fluid distributor valve constrained to rotate with the cam, and including as many pairs of orifices as the cam includes pairs of slopes, with the two orifices of a pair of orifices comprising a first orifice which corresponds to the first slope of a pair of slopes and a second orifice which corresponds to the second slope of the same pair of slopes, and with the orifice for putting each cylinder into communication with the outside of the cylinder being successively brought into communication with each pair of orifices in the distributor during rotation of the cylinder block relative to the cam; and a selector for selecting the active cylinder capacity of the mechanism and capable of conferring at least two distinct configurations on said mechanism, including a first configuration in which communication is established firstly between all of said first orifices of said pairs of distributor valve orifices and a first one of said two enclosures, and secondly between all said second orifices of said pairs of distributor valve orifices and the second of said two enclosures, and a second configuration in which the pairs of distributor valve orifices are grouped in at least two groups of pairs of orifices corresponding to at least two groups of pairs of cam slopes, said selector firstly establishing said first configuration communication solely for the orifices of a first of said two groups of pairs of distributor valve orifices, and secondly isolating at least one of said two enclosures from at least one of said first and second orifices of the pairs of orifices of the second of said two groups of pairs of orifices;

the mechanism including the improvement whereby in said second configuration the pairs of cam slopes corresponding to the pairs of orifices in the first group of pairs of distributor valve orifices are angularly distributed about the axis of relative rotation between the cylinder block and the cam in an irregular manner.

2. A mechanism according to claim 1, wherein the number of pairs of cam slopes is an even number, and wherein the number of pairs of orifices of the first group of pairs of distributor valve orifices is equal to not more than one-half of the total number of pairs of orifices in said second configuration, said pairs of orifices of the first group being distributed over an arc of a circle representing said relative rotation and extending over more than 180°.

3. A mechanism according to claim 2, characterized in that there is an even number of cylinders and that in the second configuration the number of cylinders in the first group is not greater than one-half the total number of cylinders, with the cylinders of the first group in said second configuration being distributed around an arc of a circle representing said relative rotation and extending over more than 180°.

4. A hydraulic motor or pump mechanism, constituted by:

a cylinder block;

a plurality of cylinders provided in said cylinder block, with a piston slidably mounted in each cylinder and with each cylinder being provided with an orifice for communication with the outside thereof;

a cam, said cylinder block being rotatably mounted relative to said cam about an axis of rotation, said pistons being suitable for bearing against the surface of said cam, and said cam comprising a plurality of slopes which follow one another in pairs, with each pair including a first slope going away from the cylinder block relative to the general direction of piston sliding while pressed against said cam, and with the second slope of each pair sloping towards the cylinder block relative to the general direction of piston sliding;

two enclosures, one suitable for containing high pressure fluid and the other for containing low pressure fluid;

a fluid distributor valve constrained to rotate with the cam, and including as many pairs of orifices as the cam includes pairs of slopes, with the two orifices of a pair of orifices comprising a first orifice which corresponds to the first slope of a pair of slopes and a second orifice which corresponds to the second slope of the same pair of slopes, and with the orifice for putting each cylinder into communication with the outside of the cylinder being successively brought into communication with each pair of orifices in the distributor during rotation of the cylinder block relative to the cam; and a selector for selecting the active cylinder capacity of the mechanism and suitable for conferring at least two different configurations to said mechanism, including a first configuration in which the selector establishes communication during said relative rotation between the orifice for putting each cylinder into communication with the outside from said cylinder successively with each of the two orifices in each pair of distributor valve orifices, and a second configuration in which the cylinders are distributed together with their said communication orifices in at least two groups of cylinders and two corresponding groups of communication orifices, with the selector establishing first configuration communication solely for the communication orifices of a first group of said two groups of cylinder communication orifices while simultaneously isolating at least one of said two enclosures from the communication orifices of the second group of cylinder communication orifices, said cylinders being distributed around the axis of relative rotation between the cylinder block and the cam with the axes of any pair of consecutive cylinders being at substantially at the same angular intervals;

the mechanism including the improvement whereby, in said second configuration, the cylinders of said first group are angularly distributed about said axis of relative rotation in an irregular manner, i.e. with the angular intervals between the axes of two consecutive cylinders in the first group of cylinders being unequal for at least some of the angular intervals between pairs of successive cylinders in the first group of cylinders.

* * * * *